US008736494B2

(12) United States Patent
Huang et al.

(10) Patent No.: US 8,736,494 B2
(45) Date of Patent: May 27, 2014

(54) DUAL BAND ANTENNA

(75) Inventors: Chih-Yung Huang, Taichung (TW); Kuo-Chang Lo, Miaoli Country (TW)

(73) Assignee: Arcadyan Technology Corp., Hsinchu (TW)

( * ) Notice: Subject to any disclaimer, the term of this patent is extended or adjusted under 35 U.S.C. 154(b) by 109 days.

(21) Appl. No.: 13/311,504

(22) Filed: Dec. 5, 2011

(65) Prior Publication Data

US 2013/0033399 A1 Feb. 7, 2013

(30) Foreign Application Priority Data

Aug. 2, 2011 (TW) ..... 100127475 A

(51) Int. Cl.
*H01Q 1/24* (2006.01)

(52) U.S. Cl.
USPC ..... 343/702; 343/700 MS; 343/846; 343/848

(58) Field of Classification Search
USPC ..... 343/700 MS, 702, 846, 848
See application file for complete search history.

(56) References Cited

U.S. PATENT DOCUMENTS

| | | | | |
|---|---|---|---|---|
| 5,103,238 | A | 4/1992 | Mahnad | |
| 6,222,496 | B1 | 4/2001 | Liu | |
| 6,563,466 | B2 | 5/2003 | Sadler et al. | |
| 6,644,555 | B1 | 11/2003 | Berney | |
| 6,894,647 | B2 | 5/2005 | Jenwatanavet | |
| 7,023,386 | B2 | 4/2006 | Habib et al. | |
| 7,119,748 | B2 * | 10/2006 | Autti | 343/702 |
| 7,446,717 | B2 | 11/2008 | Hung et al. | |
| 7,602,341 | B2 * | 10/2009 | Wei-Shan et al. | 343/700 MS |
| 8,085,204 | B2 * | 12/2011 | Wu et al. | 343/700 MS |
| 8,125,395 | B2 * | 2/2012 | Yang et al. | 343/702 |
| 2004/0174305 | A1 | 9/2004 | Kuo et al. | |
| 2005/0243006 | A1 | 11/2005 | Lin et al. | |
| 2005/0259024 | A1 | 11/2005 | Hung et al. | |
| 2006/0164306 | A1 | 7/2006 | Chang et al. | |
| 2006/0262016 | A1 | 11/2006 | Hung et al. | |
| 2007/0120753 | A1 | 5/2007 | Hung et al. | |

FOREIGN PATENT DOCUMENTS

| | | |
|---|---|---|
| TW | I247452 | 1/2006 |
| TW | I256749 | 6/2006 |
| WO | 0003452 A1 | 1/2000 |

* cited by examiner

*Primary Examiner* — Hoang V Nguyen
(74) *Attorney, Agent, or Firm* — Haverstock & Owens LLP

(57) ABSTRACT

A dual band antenna is provided. The dual band antenna includes a grounding portion, a connecting portion, a feeding portion, a radiating portion, a first radiating portion and a second radiating portion. The connecting portion is vertically connected to the grounding portion. The feeding portion has a first end and a second end, wherein the first end is connected to the connecting portion and the second end has a feeding end. The radiating portion is parallel to the grounding portion and vertically connected to the connecting portion. The first radiating portion has a third end and a fourth end, wherein the third end is connected to the radiating portion and the fourth end extends toward the radiating portion. The second radiating portion is vertically connected to the radiating portion.

19 Claims, 5 Drawing Sheets

DUAL BAND ANTENNA

FIELD OF THE INVENTION

This invention relates to an antenna, in particular to planar inverted-F antenna (PIFA) which is capable of operating in dual frequency bands. The application claims the benefit of priority from the Taiwan Patent Application No. 100127475, filed on Aug. 2, 2011, the contents of the specification of which are hereby incorporated herein by reference.

BACKGROUND OF THE INVENTION

In recent years, wireless communication devices, such as cellular phones, notebook computers, access point and the like are more popular with the development of science and technology. The antennas with simple structure have become increasingly popular, especially ones of which antennas operate based on the principle of inverted-F antenna.

In general, PIFA operates with the outer conductor and inner conductor of the coaxial cable to be connected to the grounding end and the signal feeding end of PIFA to transmit signals by the radiating element of PIFA. Of course, it may not use the coaxial cable and may be replaced by other grounding elements and signal transmitting units. However, the shape, the structure and the size may affect the operating frequency and matching impedance of the antenna, and the needs toward antennas may be different from a variety of devices where the antennas are disposed. Therefore, in this technical field, the engineers devote to improve the structure of the antenna constantly in order to have the best performance, reduce the occupying space and meet market demand.

Therefore, it is tried to rectify those drawbacks and provide an antenna that has a simpler structure and is more adjustable for matching impedance to integrate two bandwidths. The present invention provides a dual-band antenna in order to achieve the foresaid objective.

SUMMARY OF THE INVENTION

In order to overcome the shortcomings from prior art, a dual band antenna is provided. The dual band antenna has wider bandwidth corresponding to the different needs with respect to the efficient bandwidth in accordance with the communication protocol. The dual band antenna can also reduce the occupying space and effectively save the costs by manufacturing with less molds. The dual band antenna is suitable for use in various wireless network devices.

In accordance with one respect of the present invention, a dual band antenna is provided. The dual band antenna includes a grounding portion; a connecting portion perpendicularly connected to the grounding portion; a feeding extending portion having a first end connected to the connecting portion and a second end having a signal feeding end; a radiating portion paralleled to the grounding portion and perpendicularly connected to the connecting portion; a first radiating extending portion having a third end connected to the radiating portion and a fourth end extending toward the radiating portion; and a second radiating extending portion perpendicularly connected to the radiating portion.

Preferably, the grounding portion is on a first plane, the connecting portion and the feeding extending portion are on a second plane, the radiating portion and the first radiating extending portion are on a third plane, and the second radiating extending portion is on a fourth plane.

Preferably, the grounding portion further comprises a grounding body and a grounding end located on the second plane and perpendicularly extending from the grounding body.

Preferably, the radiating portion has a third radiating extending portion having a first extending end extending toward the radiating portion and a second extending end connected to the radiating portion, the third extending portion is of U-like shape and perpendicular to the radiating portion, and the first extending end and the second extending end are on the third plane.

Preferably, the radiating portion and the first radiating extending portion work in a first frequency band, the second radiating extending portion works in a second frequency band, and an operational frequency of the second frequency band is larger than that of the first frequency band.

Preferably, the feeding extending portion and the first radiating extending portion both have a U-like shape respectively and the connecting portion has an L-like shape.

Preferably, the connecting portion has a relatively longer part connected to the first end and a relatively shorter part connected to the grounding portion.

Preferably, the first radiating extending portion further comprises a third extending end perpendicularly extending from the first radiating extending portion.

In accordance with the aforementioned of the present invention, a dual band antenna is provided. The dual band antenna includes a grounding plane; a connecting plane having a relatively shorter part connected to the grounding plane a relatively longer part extending in a first direction, and a signal feeding end connected to the relatively longer part; and a radiating plane, having: a body connected to the connecting plane and paralleled to the grounding plane; a first radiating extending portion connected to the body and extending in the first direction and then turning to be extended in a second direction; and a second radiating extending portion connected to the body and extending in a third direction.

Preferably, the grounding plane further comprises a grounding end extending in the third direction and being on the same plane with the connecting plane.

Preferably, the connecting plane is formed by an L-like portion and a U-like portion, and the L-like portion has the relatively shorter part and the relatively longer part and the U-like portion has a first end connected to the relatively longer part and a second end having the signal feeding end extending in the third direction.

Preferably, the body is further connected to a third radiating extending portion, the third radiating extending portion has a U-like shape structure with a first extending end and a second extending end extending in a fourth direction and then turning to be extended in the first direction for connection with the body, and the first extending end extends in the fourth direction and then turns to be extended in the first direction toward the body.

Preferably, the first radiating portion further comprises a third extending end extending in the third direction.

In accordance with the aforementioned of the present invention, a dual band antenna is provided. The dual band antenna includes a first radiating portion; a second radiating portion connected to the first radiating portion; a connecting portion connected to the first radiating portion; and a grounding portion connected to the connecting portion, wherein the first radiating portion is parallel to the grounding portion and the second radiating portion is parallel to the connecting portion.

Preferably, the first radiating portion and the second radiating portion form a plane angle therebetween, the grounding portion further comprises a grounding end being on the same plane with the connecting portion, and the connecting portion further comprises a signal feeding end.

Preferably, the connecting portion further comprises an L-like portion and a U-like portion, the L-like portion has the relatively shorter part and the relatively longer part, and the U-like portion has a first end and a second end, the first end is connected to the relatively longer part, the relatively shorter part is connected to the grounding portion, and the second end has a signal feeding end.

Preferably, the first radiating portion further comprises a first radiating extending portion having a U-like structure, a radiating end and an extending end connected to the first radiating portion, and the first radiating portion further comprises a radiating extending end connected to the radiating end for matching an impedance of the first radiating portion.

Preferably, the relatively longer part and the first end extend in a first direction, the radiating end and the second end extend in a second direction, the grounding end, the signal feeding end, the radiating extending end and the second radiating portion extend in a third direction, the first radiating portion further comprises a U-like extending portion having a first extending part and a second extending part, the second extending part extends in a fourth direction and then turns to be extended in the first direction for connection with the first radiating portion, and the first extending part extends in the fourth direction and then turns to be extended in the first direction toward the first radiating portion.

In accordance with the aforementioned of the present invention, a three-dimensional antenna is provided. The three-dimensional antenna has a first to a fourth planes to being non coplanar and includes a grounding element being on the first plane; a connecting element being on the second plane and further including a feeding element, wherein the connecting element is connected to the grounding element; and a radio frequency element connected to the connecting element and having two radio frequency portions extending in different directions, wherein the two radio frequency portions are respectively located on the third plane for operating in a first frequency band and the fourth plane for operating in a second frequency band.

Preferably, the feeding element receives a signal, the second frequency band having an operational frequency larger than that of the first frequency band, and the third plane and the fourth plane have an angle therebetween, the first plane is parallel to the third plane, the second plane is parallel to the fourth plane, and the first to the fourth planes form a parallelogram.

BRIEF DESCRIPTION OF THE DRAWING

The foregoing and other features and advantages of the present invention will be more clearly understood through the following descriptions with reference to the drawings, wherein.

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
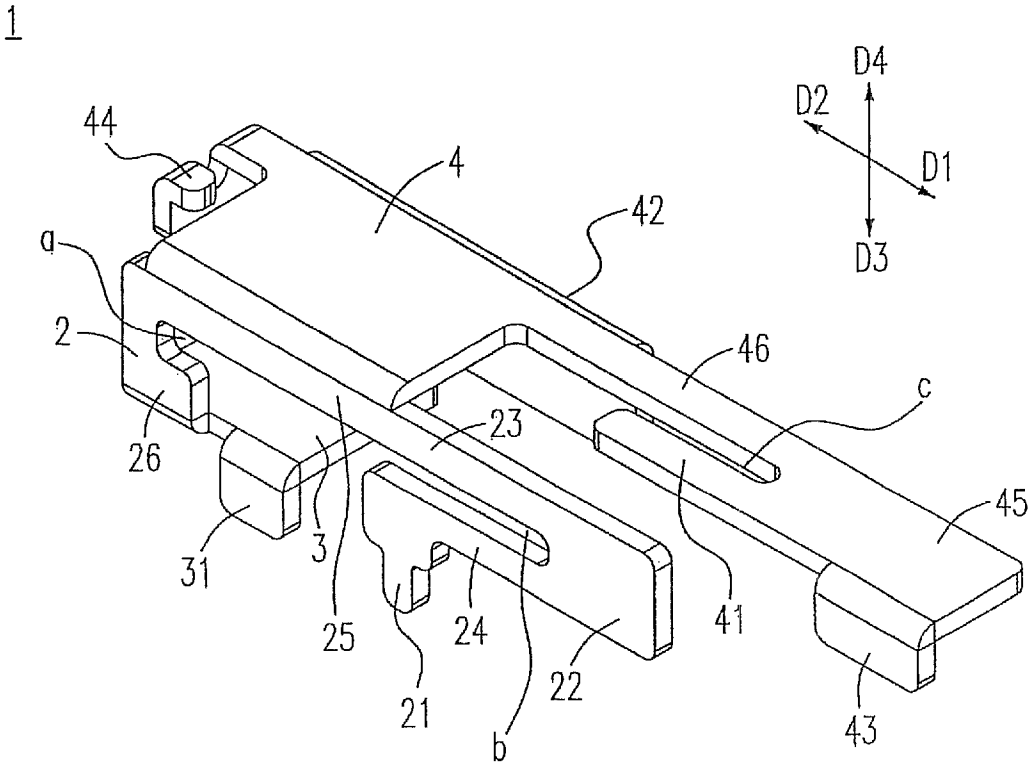
FIG. 1 is an oblique view illustrating a dual-band antenna 1 according to one embodiment of the present invention.

Please refer to FIG. 1. FIG. 1 is an oblique view illustrating a dual-band antenna 1 according to one embodiment of the present invention. The dual-band antenna 1 are made from conductive materials and preferably made from metal conductor. All these elements of the dual-band antenna 1 are integrated with a strip conductor. The dual-band antenna 1 includes a grounding portion 3, a connecting portion 2 and a radiating portion 4. The grounding portion 3 is located at a first plane and includes a grounding end 31. The grounding end 31 is located at a second plane and extends in a third direction D3. The grounding end 31 perpendicularly extends from a grounding body (a relatively larger square part of the grounding portion 3).

The connecting portion 2 is located at the second plane and connected to the grounding portion 3. The connecting portion 2 is formed with an L-like shaped part and a feeding portion 22 (U-like shaped part) and is connected to the grounding portion 3 through the L-like shaped part. The feeding portion 22 has a first end 23 and a second end 24. The second end 24 has a signal feeding end 21 extending in a third direction D3. The size and the shape of the signal feeding end 21 may be determined based on matching impedance of the dual-band antenna 1. The L-like shaped part has a relatively longer part 25 and a relatively shorter part 26. The relatively longer part 25 extends in a first direction D1 and is connected to the first end 23 of the feeding portion 22. The relatively shorter part 26 is connected to the grounding portion 3 and is configured to be perpendicular to the grounding portion 3 in a fourth direction D4.

The radiating portion 4 further includes a first radiating extending portion 45 and a second radiating extending portion 42. The radiating portion 4 and the first radiating extending portion 45 are located at a third plane. The second radiating extending portion 42 is located at a fourth plane. The first radiating extending portion 45 is a U-like shaped structure and further includes a third end (the radiating end) 46 and fourth end (the extending end) 41. The third end 46 is connected to the radiating portion 4 and extends in a second direction D2. The fourth end 41 extends toward the radiating portion 4, but is not connected to the radiating portion 4. The radiating portion 4 and the first radiating extending portion 45 may be formed a first radiating plane (4, 45). The first radiating plane (4, 45) operates in the relatively lower bandwidth ranging from 2.4 G to 2.5 GHz. The second radiating extending portion 42 is connected to the radiating portion 4 and extends in the third direction D3 (preferably perpendicular to the radiating portion 4). The second radiating extending portion 42 operates in the relatively higher bandwidth ranging from 5.15 G to 5.85 GHz.

As shown in FIG. 1, although the connecting portion 2 and the radiating portion 4 are connected to each other, the feeding portion 22 extending from the connecting portion 2 is not connected to the first radiating extending portion 45 extending from the radiating portion 4. The L-like shaped part of the connecting portion 2 further includes a groove a. The feeding portion 22 further includes a groove b. The first radiating extending portion 45 further includes a groove c. The groove a, b and c are non-closed groove. The groove a has an opening toward the first direction D1. The groove b has an opening toward the first direction D2. The groove c has an opening toward the first direction D1. The size of the groove a, b and c may be determined based on operating bandwidth and matching impedance of the dual-band antenna 1.

Figure 2:
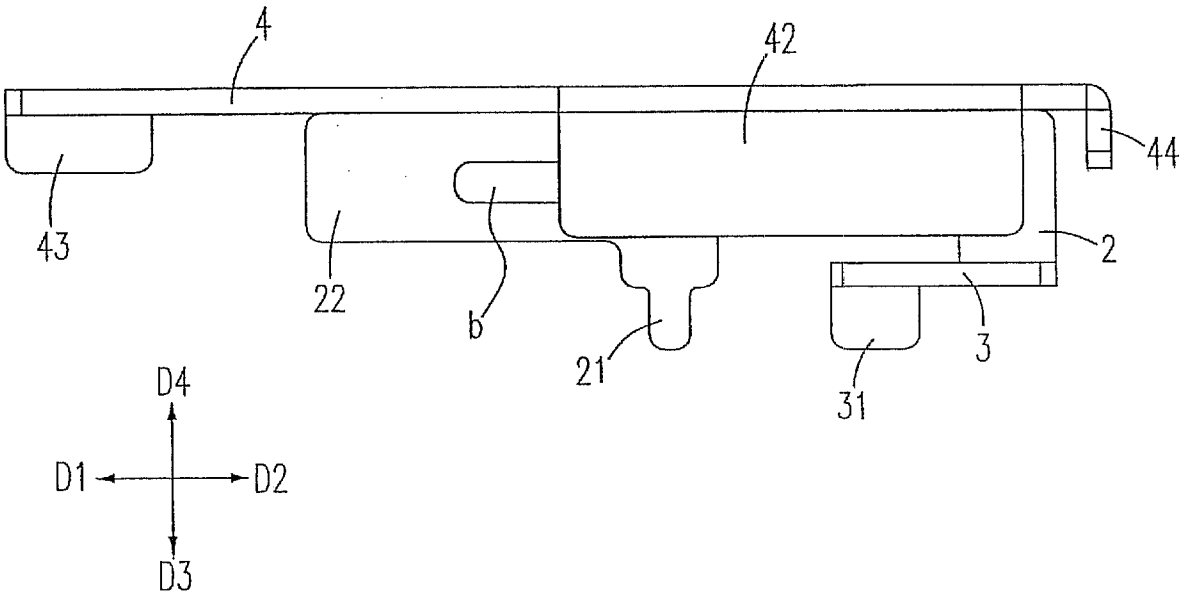
FIG. 2 is a back view illustrating a dual-band antenna 1 according to one embodiment of the present invention.

Please refer to FIG. 2. FIG. 2 is a back view illustrating a dual-band antenna 1 according to one embodiment of the present invention. As shown in FIG. 2, the signal feeding end 21, the grounding end 31 and a third radiating extending portion 44 extend in the third direction D3 and respectively perpendicular to the feeding portion 22, the grounding portion 3 and the radiating portion 4 which are severally connected thereto.

Figure 3:
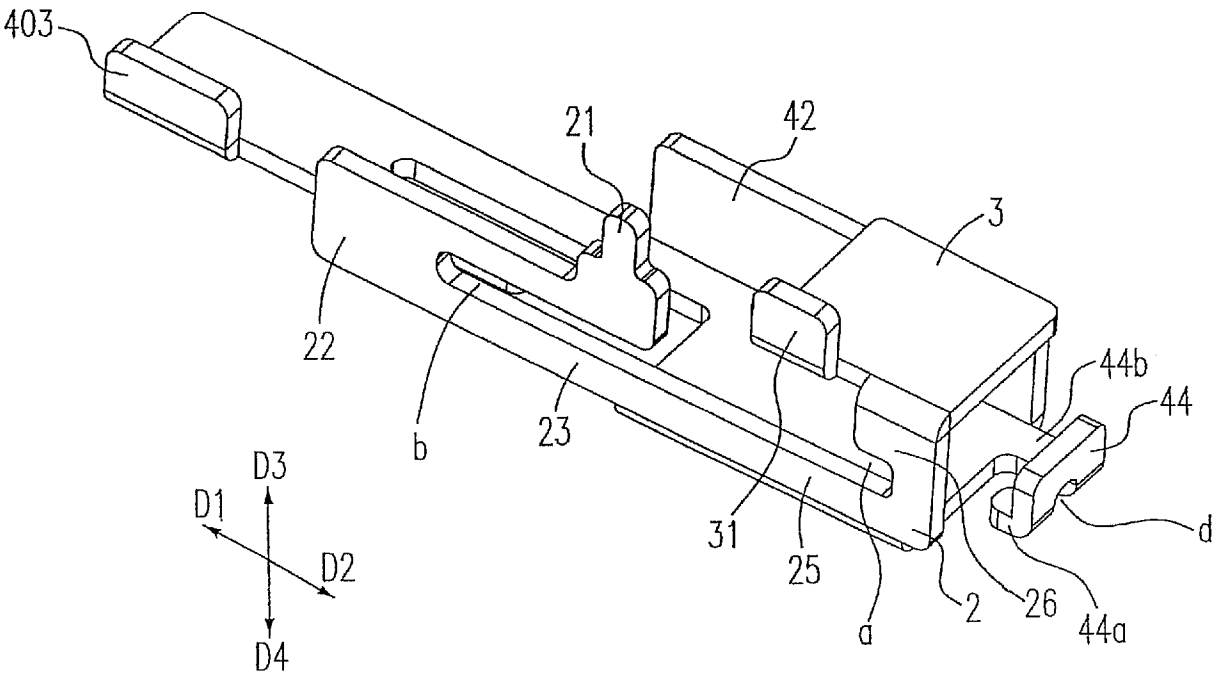
FIG. 3 is a bottom view illustrating a dual-band antenna 1 according to one embodiment of the present invention.

Please refer to FIG. 3. FIG. 3 is a bottom view illustrating a dual-band antenna 1 according to one embodiment of the present invention. As shown in FIG. 3, the radiating portion 4 further includes the third radiating extending portion 44. The third radiating extending portion 44 is a U-like shaped structure configured to be connected and perpendicular to the radiating portion 4. The third radiating extending portion 44 further includes a first extending end 44*a* and a second extending end 44*b* on the third plane.

The second extending end 44*b* is connected to the radiating portion 4. One part of the first extending end 44*a* extends in the fourth direction D4, and then the other part of the first extending end 44*a* turns to be extended toward the radiating portion 4 (in the first direction D1) but is not connected to the radiating portion 4. One part of the second extending end 44*b* extends in the fourth direction D4, and then the other part of the second extending end 44*b* turns to be extended in the first direction D1 to be connected to the radiating portion 4. Although the first extending end 44*a* and the second extending end 44*b* are both connected to the third radiating portion 44, the other part of each is located at the third plane with the radiating portion 4. Because the third radiating extending portion 44 is configured for matching impedance of the dual-band antenna 1, the size and the shape of which may be determined based on operating bandwidth and matching impedance of the dual-band antenna 1. The first radiating extending portion 45 further includes a radiating extending end (third extending end) 43 extending in the third direction D3. The radiating extending end 43 is configured for matching impedance of the dual-band antenna 1, the size and the shape of which may be determined based on operating bandwidth and matching impedance of the dual-band antenna 1.

As shown in FIG. 3, the third radiating extending portion 44 has a groove d having an opening toward the first direction D1. The size of the groove d may be adjusted as needed.

Figure 4:
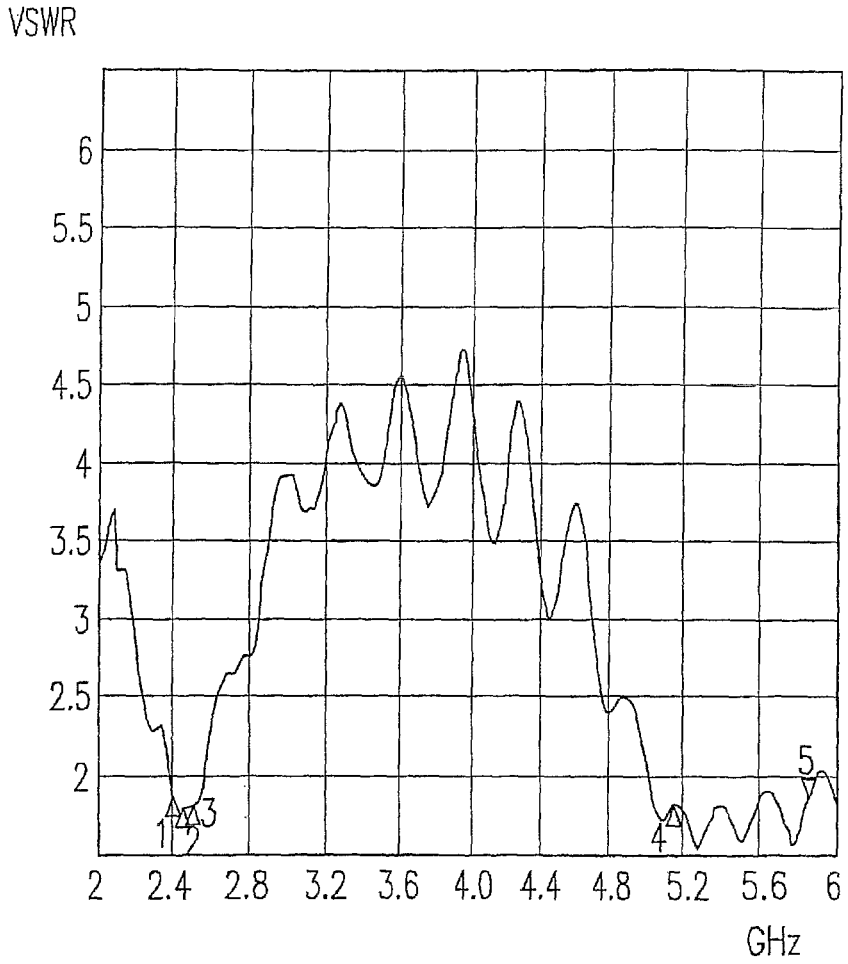
FIG. 4 is a waveform test chart for the dual-band antenna 1 about voltage standing wave ratio (VSWR) as a function of frequency according to one embodiment of the present invention.

Please refer to FIG. 4. FIG. 4 is a waveform test chart for the dual-band antenna about voltage standing wave ratio (VSWR) as a function of frequency according to one embodiment of the present invention. As shown in FIG. 4, triangular mark 1~5 respectively represent the VSWR values which are 1.7166 (2.4 GHz), 1.5799 (2.45 GHz), 1.6108 (2.5 GHz), 1.5957 (5.15 GHz), 1.6948 (5.85 GHz). The VSWR values in the operating bandwidths of the dual-band antenna 1 are less than 2 and even less than 1.6. It means that the embodiment of the present invention shows quite satisfactory performance.

TABLE 1

| | Frequency (GHz) | | | | | | | | |
|---|---|---|---|---|---|---|---|---|---|
| | 2.45 | | | 5.15 | | | 5.85 | | |
| Plane | XY | YZ | XZ | XY | YZ | XZ | XY | YZ | XZ |
| Peak (dBi) | −0.24 | −1.13 | 0.42 | −0.86 | −0.22 | 1.22 | 2.87 | 2.79 | 3.10 |
| Average (dBi) | −4.05 | −4.71 | −1.62 | −3.66 | −3.56 | −1.95 | −1.92 | −2.13 | −0.19 |

Table 1 shows the test data of the antenna gain based on the operation of the dual-band antenna 1 in several bandwidths (2.45 GHz, 5.15 GHz and 5.85 GHz). As shown in Table 1, the antenna gain is even larger than 3 dBi. It is obvious that the present invention can meet market demand and perform ideally.

Figure 5:
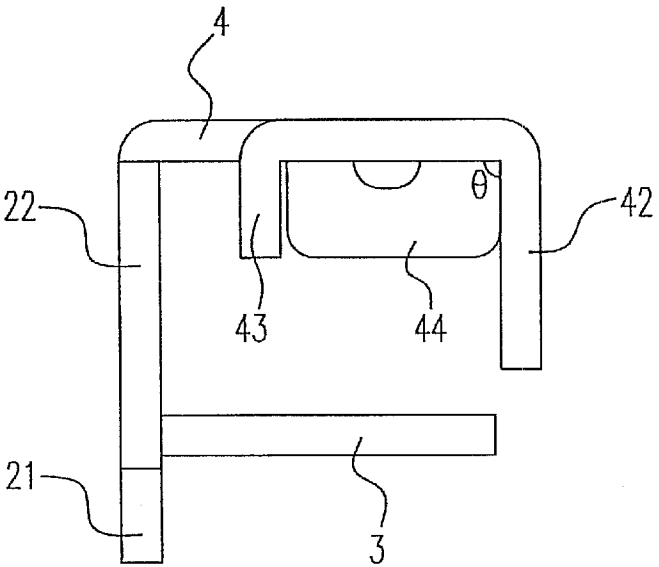
FIG. 5 is a side view illustrating a dual-band antenna 1 according to one embodiment of the present invention.

Please refer to FIG. 5. FIG. 5 is a side view illustrating the dual-band antenna 1 according to one embodiment of the present invention. As shown in FIG. 5 from the side (to the second direction D2) of the dual-band antenna 1, the grounding plane 3, the connecting plane 2 (including the connecting plane 2 covered by the feeding portion 22), the radiating plane (also including the body 4 and the first radiating extending portion 45) and the second radiating extending portion 42 are configured to form a parallelogram. The middle of the parallelogram is a hollow cavity. The second radiating portion 42 and the grounding plane 3 do not cross with each other. When the dihedral angle θ between the radiating plane and the second radiating extending portion 42 is 90°, the grounding plane 3, the connecting plane 2, the radiating plane and the second radiating extending portion 42 form a rectangle.

The dihedral angle θ may not be 90° and may have a value between 0° to 90°. In this range, the second radiating extending portion 42 may be paralleled to the connecting plane 2 and the radiating plane 4 may be paralleled to the grounding plane 3. Thus, the grounding plane 3, the connecting plane 2, the radiating plane 4 and the second radiating extending portion 42 may be configured to form a parallelogram. The dual-band antenna 1 according to another embodiment of the present invention includes the grounding plane 3, the connecting plane 2 having the relatively shorter part 26 connected to the grounding plane 3 and the relatively longer part 25 extending in the first direction D1 to be connected to the signal feeding end 21, the radiating plane including a body 4 connected to the connecting plane 2 and paralleled to the grounding plane 3 and the first radiating extending portion 45 connected to the body and extending in the first direction D1 and then turning to be extended in the second direction D2, and the second radiating extending portion 42 connected to the body 4 and extending in the third direction D3.

The dual-band antenna 1 according to the other embodiment of the present invention includes a first radiating portion (4,45), the second radiating extending portion 42 connected to the first radiating portion (4,45) and forming a plane angle (dihedral angle) θ therebetween, the connecting portion 2 connected to the first radiating portion (4,45); and the grounding portion 3 connected to the connecting portion, wherein the first radiating portion (4,45) is parallel to the grounding portion 3 and the second radiating portion 42 is parallel to the connecting portion 2. The first radiating portion (4,45) and the second radiating extending portion 42 may not be perpendicular and the angle θ may be adjusted as needed.

The present invention can be applied to wireless communication devices, such as notebooks, tablet PCs, mobile phones, wireless access devices, display or audio player with Wi-Fi and so on.

There are more embodiments provided as follows.

Embodiment 1: A dual band antenna including a grounding portion; a connecting portion perpendicularly connected to the grounding portion; a feeding extending portion having a first end connected to the connecting portion and a second end having a signal feeding end; a radiating portion paralleled to the grounding portion and perpendicularly connected to the connecting portion; a first radiating extending portion having a third end connected to the radiating portion and a fourth end extending toward the radiating portion; and a second radiating extending portion perpendicularly connected to the radiating portion.

Embodiment 2: The dual band antenna according to embodiment 1, wherein the grounding portion is on a first plane, the connecting portion and the feeding extending portion are on a second plane, the radiating portion and the first radiating extending portion are on a third plane, and the second radiating extending portion is on a fourth plane.

Embodiment 3: The dual band antenna according to embodiment 2, wherein the grounding portion further includes a grounding body and a grounding end located on the second plane and perpendicularly extending from the grounding body.

Embodiment 4: The dual band antenna according to embodiment 2, wherein the radiating portion has a third radiating extending portion having a first extending end extending toward the radiating portion and a second extending end connected to the radiating portion, the third extending portion is of U-like shape and perpendicular to the radiating portion, and the first extending end and the second extending end are on the third plane.

Embodiment 5: The dual band antenna according to embodiment 1, wherein the radiating portion and the first radiating extending portion work in a first frequency band, the second radiating extending portion works in a second frequency band, and an operational frequency of the second frequency band is larger than that of the first frequency band.

Embodiment 6: The dual band antenna according to embodiment 1, wherein the feeding extending portion and the first radiating extending portion both have a U-like shape respectively and the connecting portion has an L-like shape.

Embodiment 7: The dual band antenna according to embodiment 1, wherein the connecting portion has a relatively longer part connected to the first end and a relatively shorter part connected to the grounding portion.

Embodiment 8: The dual band antenna according to embodiment 4, wherein the first radiating extending portion further includes a third extending end perpendicularly extending from the first radiating extending portion.

Embodiment 9: A dual band antenna including a grounding plane; a connecting plane having a relatively shorter part connected to the grounding plane a relatively longer part extending in a first direction, and a signal feeding end connected to the relatively longer part; and a radiating plane, having a body connected to the connecting plane and paralleled to the grounding plane; a first radiating extending portion connected to the body and extending in the first direction and then turning to be extended in a second direction; and a second radiating extending portion connected to the body and extending in a third direction.

Embodiment 10: The dual band antenna according to embodiment 9, wherein the grounding plane further includes a grounding end extending in the third direction and being on the same plane with the connecting plane.

Embodiment 11: The dual band antenna according to embodiment 9, wherein the connecting plane is formed by an L-like portion and a U-like portion, and the L-like portion has the relatively shorter part and the relatively longer part and the U-like portion has a first end connected to the relatively longer part and a second end having the signal feeding end extending in the third direction.

Embodiment 12: The dual band antenna according to embodiment 9, wherein the body is further connected to a third radiating extending portion, the third radiating extending portion has a U-like shape structure with a first extending end and a second extending end extending in a fourth direction and then turning to be extended in the first direction for connection with the body, and the first extending end extends in the fourth direction and then turns to be extended in the first direction toward the body.

Embodiment 13: The dual band antenna according to embodiment 12, wherein the first radiating portion further includes a third extending end extending in the third direction.

Embodiment 14: A dual band antenna including a first radiating portion; a second radiating portion connected to the first radiating portion; a connecting portion connected to the first radiating portion; and a grounding portion connected to the connecting portion, wherein the first radiating portion is parallel to the grounding portion and the second radiating portion is parallel to the connecting portion.

Embodiment 15: The dual band antenna according to embodiment 14, wherein the first radiating portion and the second radiating portion form a plane angle therebetween, the grounding portion further includes a grounding end being on the same plane with the connecting portion, and the connecting portion further includes a signal feeding end.

Embodiment 16: The dual band antenna according to embodiment 14, wherein the connecting portion further includes an L-like portion and a U-like portion, the L-like portion has the relatively shorter part and the relatively longer part, and the U-like portion has a first end and a second end, the first end is connected to the relatively longer part, the relatively shorter part is connected to the grounding portion, and the second end has a signal feeding end.

Embodiment 17: The dual band antenna according to embodiment 16, wherein the first radiating portion further includes a first radiating extending portion having a U-like structure, a radiating end and an extending end connected to the first radiating portion, and the first radiating portion further includes a radiating extending end connected to the radiating end for matching an impedance of the first radiating portion.

Embodiment 18: The dual band antenna according to embodiment 17, wherein the relatively longer part and the first end extend in a first direction, the radiating end and the second end extend in a second direction, the grounding end, the signal feeding end, the radiating extending end and the second radiating portion extend in a third direction, the first radiating portion further includes a U-like extending portion having a first extending part and a second extending part, the second extending part extends in a fourth direction and then turns to be extended in the first direction for connection with the first radiating portion, and the first extending part extends in the fourth direction and then turns to be extended in the first direction toward the first radiating portion.

Embodiment 19: A three-dimensional antenna, having a first to a fourth planes to being non coplanar including a grounding element being on the first plane; a connecting element being on the second plane and further including a feeding element, wherein the connecting element is connected to the grounding element; and a radio frequency element connected to the connecting element and having two radio frequency portions extending in different directions, wherein the two radio frequency portions are respectively located on the third plane for operating in a first frequency band and the fourth plane for operating in a second frequency band.

Embodiment 20: The three-dimensional antenna according to embodiment 19, wherein the feeding element receives a signal, the second frequency band having an operational frequency larger than that of the first frequency band, and the third plane and the fourth plane have an angle therebetween, the first plane is parallel to the third plane, the second plane is parallel to the fourth plane, and the first to the fourth planes form a parallelogram.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claim is:

1. A dual band antenna, comprising:

a grounding portion;

a connecting portion perpendicularly connected to the grounding portion;

a feeding extending portion having a first end connected to the connecting portion and a second end having a signal feeding end;

a radiating portion paralleled to the grounding portion and perpendicularly connected to the connecting portion;

a first radiating extending portion having a third end connected to the radiating portion and a fourth end extending toward the radiating portion; and a second radiating extending portion perpendicularly connected to the radiating portion.

2. The dual band antenna according to claim 1, wherein the grounding portion is on a first plane, the connecting portion and the feeding extending portion are on a second plane, the radiating portion and the first radiating extending portion are on a third plane, and the second radiating extending portion is on a fourth plane.

3. The dual band antenna according to claim 2, wherein the grounding portion further comprises a grounding body and a grounding end located on the second plane and perpendicularly extending from the grounding body.

4. The dual band antenna according to claim 2, wherein the radiating portion has a third radiating extending portion having a first extending end extending toward the radiating portion and a second extending end connected to the radiating portion, the third extending portion is of U-like shape and perpendicular to the radiating portion, and the first extending end and the second extending end are on the third plane.

5. The dual band antenna according to claim 4, wherein the first radiating extending portion further comprises a third extending end perpendicularly extending from the first radiating extending portion.

6. The dual band antenna according to claim 1, wherein the radiating portion and the first radiating extending portion work in a first frequency band, the second radiating extending portion works in a second frequency band, and an operational frequency of the second frequency band is larger than that of the first frequency band.

7. The dual band antenna according to claim 1, wherein the feeding extending portion and the first radiating extending portion both have a U-like shape respectively and the connecting portion has an L-like shape.

8. The dual band antenna according to claim 1, wherein the connecting portion has a relatively longer part connected to the first end and a relatively shorter part connected to the grounding portion.

9. A dual band antenna, comprising:

a grounding plane;

a connecting plane having a relatively shorter part connected to the grounding plane a relatively longer part extending in a first direction, and a signal feeding end connected to the relatively longer part; and a radiating plane, having:

a body connected to the connecting plane and paralleled to the grounding plane;

a first radiating extending portion connected to the body and extending in the first direction and then turning to be extended in a second direction; and a second radiating extending portion connected to the body and extending in a third direction.

10. The dual band antenna according to claim 9, wherein the grounding plane further comprises a grounding end extending in the third direction and being on the same plane with the connecting plane.

11. The dual band antenna according to claim 9, wherein the connecting plane is formed by an L-like portion and a U-like portion, and the L-like portion has the relatively shorter part and the relatively longer part and the U-like portion has a first end connected to the relatively longer part and a second end having the signal feeding end extending in the third direction.

12. The dual band antenna according to claim 9, wherein the body is further connected to a third radiating extending portion, the third radiating extending portion has a U-like shape structure with a first extending end and a second extending end extending in a fourth direction and then turning to be extended in the first direction for connection with the body, and the first extending end extends in the fourth direction and then turns to be extended in the first direction toward the body.

13. The dual band antenna according to claim 12, wherein the first radiating portion further comprises a third extending end extending in the third direction.

14. A dual band antenna, comprising:

a first radiating portion;

a second radiating portion connected to the first radiating portion;

a connecting portion connected to the first radiating portion; and a grounding portion connected to the connecting portion, wherein the first radiating portion is parallel to the grounding portion, the second radiating portion is parallel to the connecting portion, the connecting portion further comprises an L-like portion and a U-like portion, the L-like portion has a relatively shorter part and a relatively longer part, the U-like portion has a first end and a second end, the first end is connected to the relatively longer part, the relatively shorter part is connected to the grounding portion, and the second end has a signal feeding end.

15. The dual band antenna according to claim 14, wherein the first radiating portion and the second radiating portion form a plane angle therebetween, the grounding portion further comprises a grounding end being on the same plane with the connecting portion, and the connecting portion further comprises a signal feeding end.

16. The dual band antenna according to claim 14, wherein the first radiating portion further comprises a first radiating extending portion having a U-like structure, a radiating end and an extending end connected to the first radiating portion, and the first radiating portion further comprises a radiating extending end connected to the radiating end for matching an impedance of the first radiating portion.

17. The dual band antenna according to claim 16, wherein the relatively longer part and the first end extend in a first direction, the radiating end and the second end extend in a second direction, the grounding end, the signal feeding end, the radiating extending end and the second radiating portion extend in a third direction, the first radiating portion further comprises a U-like extending portion having a first extending part and a second extending part, the second extending part extends in a fourth direction and then turns to be extended in the first direction for connection with the first radiating portion, and the first extending part extends in the fourth direction and then turns to be extended in the first direction toward the first radiating portion.

18. A three-dimensional antenna, having a first to a fourth planes being non coplanar, comprising:

a grounding element being on the first plane;

a connecting element being on the second plane and further including a feeding element, wherein the connecting element is connected to the grounding element; and a radio frequency element connected to the connecting element and having two radio frequency portions extending in different directions, wherein the two radio frequency portions are respectively located on the third plane for operating in a first frequency band and the fourth plane for operating in a second frequency band, and the second plane and the fourth plane respectively have a first and a second normals being parallel and pointed in opposite directions.

19. The three-dimensional antenna according to claim 18, wherein the feeding element receives a signal, the second frequency band has an operational frequency larger than that of the first frequency band, and the third plane and the fourth plane have an angle therebetween, the first plane is parallel to the third plane, the second plane is parallel to the fourth plane, and the first to the fourth planes form a parallelogram.

* * * * *